US008960097B2

(12) United States Patent
Fritsche

(10) Patent No.: US 8,960,097 B2
(45) Date of Patent: Feb. 24, 2015

(54) DYNAMIC LOADING SYSTEM FOR A RIDE VEHICLE

(75) Inventor: Joel L. Fritsche, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 633 days.

(21) Appl. No.: 12/241,460

(22) Filed: Sep. 30, 2008

(65) Prior Publication Data

US 2010/0078291 A1 Apr. 1, 2010

(51) Int. Cl.
*A63G 1/00* (2006.01)
*B66B 21/10* (2006.01)

(52) U.S. Cl.
CPC ..... *B66B 21/10* (2013.01)
USPC ..... 104/53; 198/324

(58) Field of Classification Search
USPC ..... 104/27, 28, 30, 31; 198/321, 325, 324
See application file for complete search history.

(56) References Cited

U.S. PATENT DOCUMENTS

| | | | | |
|---|---|---|---|---|
| 5,564,984 | A | 10/1996 | Mirabella et al. | |
| 5,935,011 | A | 8/1999 | Morgan et al. | |
| 6,227,790 | B1 | 5/2001 | Mollick et al. | |
| 6,340,280 | B1 | 1/2002 | Mollick et al. | |
| 6,517,443 | B1 | 2/2003 | Villella | |
| 2008/0236992 | A1 * | 10/2008 | Illedits et al. | 198/325 |

OTHER PUBLICATIONS

Photo 1, Finding Nemo Submarine Voyage Attraction, Disneyland, Anaheim, California, 1 page, at least as early as Sep. 16, 2008.
Photo 2, Finding Nemo Submarine Voyage Attraction, Disneyland, Anaheim, California, 1 page, at least as early as Sep. 16, 2008.
Photo 3, Finding Nemo Submarine Voyage Attraction, Disneyland, Anaheim, California, 1 page, at least as early as Sep. 16, 2008.
Photo 4, Finding Nemo Submarine Voyage Attraction, Disneyland, Anaheim, California, 1 page, at least as early as Sep. 16, 2008.
Photo 5, Finding Nemo Submarine Voyage Attraction, Disneyland, Anaheim, California, 1 page, at least as early as Sep. 16, 2008.
Photo 6, Jungle Cruise Attraction, Disneyland, Anaheim, California, 1 page, at least as early as Sep. 16, 2008.
Photo 7, Jungle Cruise Attraction, Disneyland, Anaheim, California, 1 page, at least as early as Sep. 16, 2008.
Photo 8, Jungle Cruise Attraction, Disneyland, Anaheim, California, 1 page, at least as early as Sep. 16, 2008.
Photo 9, Jungle Cruise Attraction, Disneyland, Anaheim, California, 1 page, at least as early as Sep. 16, 2008.
Photo 10, Jungle Cruise Attraction, Disneyland, Anaheim, California, 1 page, at least as early as Sep. 16, 2008.
Photo 11, Jungle Cruise Attraction, Disneyland, Anaheim, California, 1 page, at least as early as Sep. 16, 2008.
Photo 12, Jungle Cruise Attraction, Disney's California Adventure, Anaheim, California, 1 page, at least as early as Sep. 16, 2008.
Kali River Turntable, showing turntable for ride entry/exit, Mar. 7, 2008, submitted on CD-ROM.

* cited by examiner

*Primary Examiner* — Jason C Smith
(74) *Attorney, Agent, or Firm* — Dorsey & Whitney LLP

(57) ABSTRACT

A ride vehicle loading interface system to allow guests in wheelchairs to access a ride vehicle and enjoy a ride attraction. The loading interface system includes a plurality of associated ride vehicles moving on a track. At least one ride vehicle including a tray extendable from and retractable into the ride vehicle through an opening, the tray for receiving a wheelchair and for allowing the wheelchair to be positioned in the ride vehicle. The ride vehicle loading interface system including a loading platform moving at about the same rate as the ride vehicle during loading and unloading.

31 Claims, 9 Drawing Sheets

DYNAMIC LOADING SYSTEM FOR A RIDE VEHICLE

FIELD OF THE INVENTION

The present invention relates to a loading system for ride vehicles. More particularly, the present invention relates to a loading system for ride vehicles that facilitate both able bodied passengers and passengers in wheelchairs.

BACKGROUND

Some amusement park attractions or rides have ride dynamics that are favorable for ride participation in a wheelchair. In order for a wheelchair user to use the ride, they must access and enter a ride vehicle. One solution is to have the train of ride vehicles stop at the mount/dismount platform for loading and unloading riders from the individual ride vehicles. Another solution is to slow down the train of ride vehicles from the ride speed to a reduced speed and have a mount/dismount platform that moves at this reduced speed. Currently, this reduced speed is helpful because the access ramps on ride vehicles require multiple manipulation to fold and unfold for use by an operator or a passenger in a wheelchair. Other ride attractions use a rotating turntable, however for ambulatory riders only, meaning passengers in a wheelchair may not participate on those rides without transferring out of a wheelchair.

There is a need for a loading system to allow access by passengers in wheelchairs to amusement park attractions without substantially stopping the train of ride vehicles at the loading platform.

SUMMARY

A loading system for a ride attraction to allow passengers in wheelchairs to load and unload ride vehicles is provided. More particularly, a loading and unloading platform that moves along with the train of ride vehicles, with associated structure for a wheelchair to access an individual ride vehicle, is provided.

One aspect of the present invention includes a ride loading interface system for allowing at least one rider to access a ride vehicle, the system including a plurality of associated ride vehicles moving on a track at a rate greater than zero. Each ride vehicle includes an opening, with at least one ride vehicle including a tray extendable from and retractable into the at least one ride vehicle through the opening. The tray is for receiving a wheelchair and for allowing a wheelchair to be positioned in the ride vehicle. A loading deck may be positioned adjacent the track and the plurality of ride vehicles, the loading deck being a rotating platform or a moving walkway having a rate of motion greater than zero such that the portion of the platform adjacent the track is moving at about the same rate as the plurality of ride vehicles. At least one access structure, such as a ramp, extends adjacent the loading deck to allow guests to enter onto and exit from the loading deck. Guests may transition from the structure to the loading deck with a small change in relative velocity of the rider to the loading deck.

A further aspect of the invention includes the track guiding the plurality of ride vehicles along at least a portion having a curved path. The loading deck may include a platform rotating about a center of rotation. The access structure may extend to adjacent the center of rotation of the platform to allow a rider to transition from the structure to the platform at a small change in angular velocity.

In another aspect of the invention, a ride loading interface system described herein includes a ride vehicle including a chassis having an interior, a tray retractable and extendable from the interior through an opening, the tray including a receiving area for a wheelchair, and having at least one edge positioned adjacent the platform. When extended adjacent to the platform, the wheelchair may access the receiving area and the tray may be retracted into the interior space of the chassis. The tray may be movingly engaged with the chassis. The tray may be a cassette disengageable from the chassis.

Another aspect of the invention may include a method of loading a guest in a wheelchair onto or off of a ride vehicle in a ride attraction, which method includes the steps or acts of moving a ride vehicle at a rate of speed approximately the same as the rate of speed of a loading deck associated with the ride vehicle, where both rates of motion are greater than zero, extending a tray from the ride vehicle over the loading deck to receive the guest in a wheelchair, and retracting the tray into the ride vehicle to position the guest in a wheelchair inside the ride vehicle. The loading deck may move linearly or in a curved motion. Further, the rate of motion of the ride vehicle during loading may be similar to the rate of motion of the ride vehicle through at least a portion of the rest of the path through the ride attraction. A method of unloading a guest in a wheelchair having substantially the same steps or acts is contemplated, with the difference being that the guest in a wheelchair is moved off of the tray when the tray is in the extended position.

Other features and advantages of the present invention will become apparent from the following detailed description, taken in conjunction with the accompanying drawings, which illustrate, by way of example, the principles of the invention.

DETAILED DESCRIPTION

Ride attractions in amusement parks are designed to help the guests in attendance enjoy their experience. Some ride attractions are designed for adventurous guests who want the physical thrill of moving in unique motions at a high rate of speed. Other ride attractions are designed more for experiencing the surroundings of the ride, and for an experience that is more inclusive of people with different types of expectations. For the ride attractions that are more inclusive, it is contemplated that people with special needs would enjoy the experience, and the train of ride vehicles is often designed to accommodate those special needs.

Typically, in a train of ride vehicles designed for those with special needs, at least some of the ride vehicles are designed to carry wheelchair-bound guests. These specially designed ride vehicles are designated wheelchair accessible vehicles (hereafter "WAV"). WAVs are typically designed to allow a guest in a wheelchair to load and unload from the WAV at the ride platform, and to ride in the vehicle either by themselves, or with a companion.

One aspect of any guest's enjoyment of a ride attraction is how efficiently the ride is loaded and unloaded, which translates into shorter lines that move more quickly, and also translates into higher ride capacity per hour. Another aspect is to provide those without the ability to transfer from their wheelchair an opportunity to ride an attraction. Any perceived delay in the loading and unloading process can dampen an otherwise pleasant experience for all guests. The loading and unloading of a WAV is typically more involved than loading and unloading of ambulatory guests into and out of a regular ride vehicle. One aspect of the present invention is to facilitate loading and unloading WAVs in a ride attraction in a manner that maintains a high level of efficiency and in a way that guests in wheelchairs feel welcome and encouraged to participate.

Figure 1:
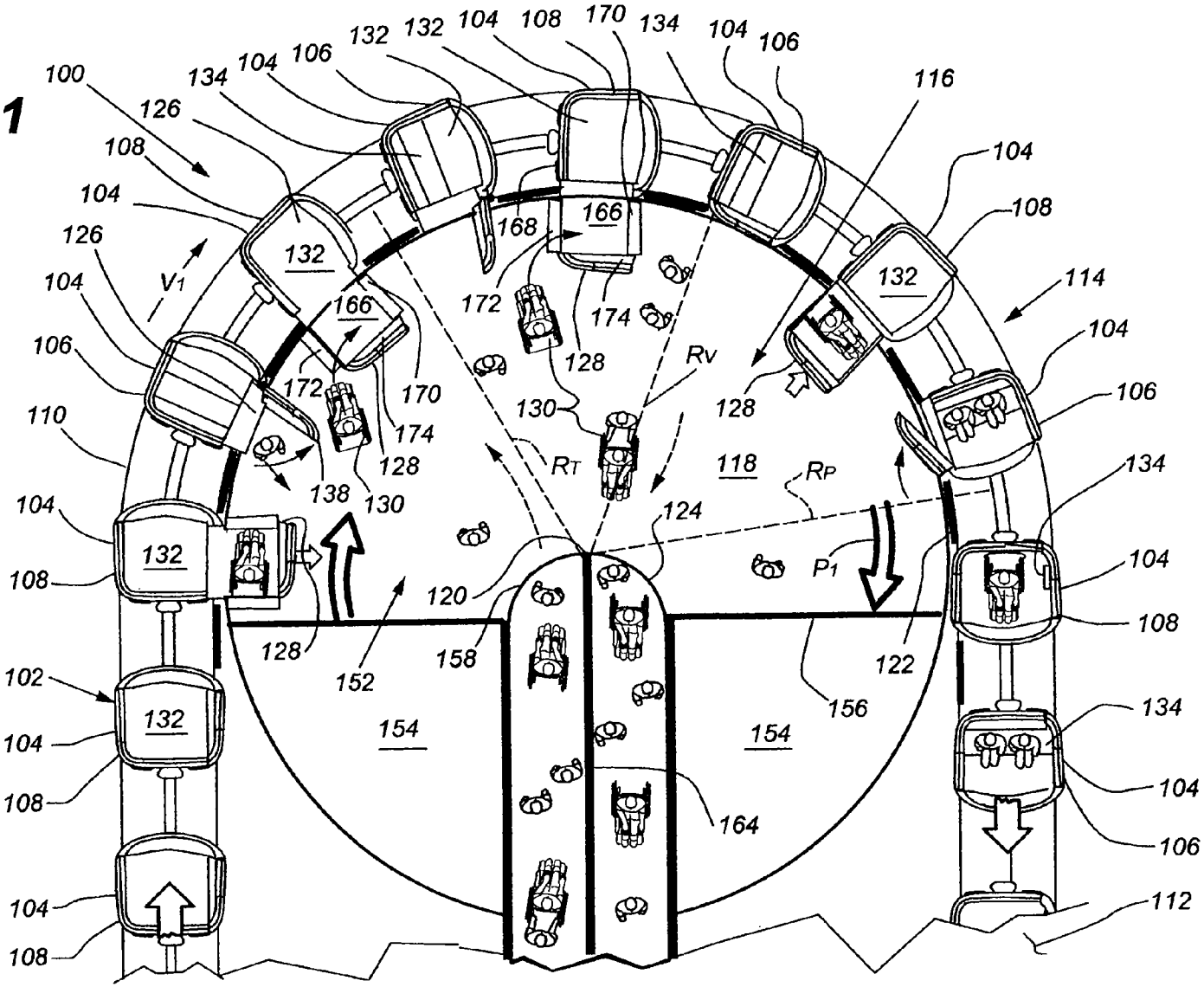
FIG. 1 illustrates a loading system including a rotating platform moving along with the train of ride vehicles, with a mounting structure extending to a center of rotation of the platform.

FIG. 1 shows a ride attraction 100 including a train 102 of interconnected ride vehicles 104, with some of the ride vehicles 106 being for ambulatory guests and others being WAVs 108 for guests in wheelchairs. The ride attraction 100 includes a track 110 that guides the train 102 of vehicles 104 around a circuit and through two general areas. For instance, one general area is the entertainment area 112, where the guests experience the environment of the ride attraction 100, such as a rain forest, ghost town, spaceships, rivers or other desired attraction. The other general area is the loading and unloading area 114. The loading and unloading area 114 utilizes a loading system 116 for the ride attraction 100 to efficiently load and unload guests from the ride attraction 100. The loading system 116 includes a portion of the track 110 that guides the train of ride vehicles 104 around a curve, a platform 118 rotating about a center of rotation 120 such that the effective periphery 122 of the platform 118 moves at about the same rate of speed as the ride vehicles 104, and a ramp 124 for delivering guests to and from the platform 118 to load and unload the ride vehicles 104.

Remaining with FIG. 1, the train 102 of ride vehicles 104 includes a plurality of ride vehicles movably connected together to move along the track 110 under self-power or by being moved by a chain, cable, or other means. The track 110 guides the ride vehicles 104 through the ride attraction 100 at a desired speed or speed for a desired duration. Each type of ride vehicle 104 includes an opening 126 to allow a guest to load into and unload from the vehicle 104 onto the platform 118. The opening 126 is sized and positioned in the ride vehicle for ease of use. The opening 126 may be uncovered and without a containment barrier, or may be selectively closed by a containment barrier, such as a door, fold-up ramp, chain, or other structure. A slide tray 128 may selectively extend from and retract into a WAV 108 to allow a wheelchair user to load and unload from the WAV 108. The tray 128 may be actuated manually by an attendant, the guest, or automatically controlled by a control program interactive with the control program of the vehicle train as described below.

To load a guest in a wheelchair 130 into a WAV 108, as is described in more detail below, the tray 128 is first moved from the retracted position into the extended position. When in the extended position, the tray 128 is pulled far enough out from the WAV 108 to allow a guest in a wheelchair 130 to move from the platform 118 onto the tray 128. The tray 128 is positioned close enough to the platform 118 to allow the wheelchair 130 to move onto the tray 128 while moving in the same direction as the vehicle 104. The tray 128 is then moved into the retracted position to load the guest into the WAV 108. When ready to unload, the tray 128 is moved from the retracted position to the extended position and the guest in the wheelchair 130 moves off the tray 128 onto the platform 118 in the same direction as the direction of the ride vehicle 104. This loading and unloading using a tray 128 or other structures is described in greater detail below. The guest in a wheelchair 130 may load and unload onto the platform 118 from the tray 128 in the direction opposite the motion of vehicle 104, and may load and unload moving frontwardly or rearwardly in the wheelchair.

A seating area 132 is located inside the ride vehicle 106, and may include a permanent or fold-up seat 134 for one or more guests. In a WAV 108, the seating area 132 may include a space for a wheelchair 130 to maneuver, and may also include a guest seat 134 either permanently positioned or able to be selectively folded out for use or folded away for stowage. The ride vehicles 104 may also include hand grips 136 (See FIG. 3) for grasping by the guest during the duration of the ride. The ride vehicles 104 may, depending on the ride attraction, include a roof and window or window openings, or, as shown herein, may not have a roof structure at all.

The ride vehicles 104 may be mounted on the track 110 separately from one another to move individually under their own power, but in some coordination with the other ride vehicles. It is contemplated that the track 110, as defined herein, may include a rail structure as defined below, or another guide structure for guiding the ride vehicles around or along a portion of a ride attraction. Other guide structures may include a channel structure in which the ride vehicles move, a water pathway in which the ride vehicles move, an overhead suspension structure supporting the ride vehicles from above, and electronic guidance systems, such as magnetic tape guidance or GPS guidance systems, or other automated guided vehicle technologies and other such structures and systems. Also, the ride vehicles 104 may rotate about an axis relative to the track 110 to enhance the guest's experience and add dimension to the ride attraction 100. The train 102 of ride vehicles 104 may move under the control of a human operator, or may move under the control of an automatic program controlling the drive mechanism of the train 102 of ride vehicles 104, or a combination of both. As described in more detail below, the train 102 of ride vehicles 104 moves through the loading and unloading area 114 to unload the existing guests from the ride vehicles 104, and load up new guests into the ride vehicles for the next circuit through the ride attraction 100. The vehicle train 102 may transit through the loading area 114 at the same or similar speeds as it passes through the entertainment area 112 of the ride attraction 100. In this way, the loading and unloading of guests may not significantly slow the motion of the vehicle train 102, and thus allows the vehicle train to run more efficiently and make more trips per unit time. The vehicle train 102 may also slow or stop in the loading area to load and unload guests if desired. The efficient, convenient, and safe loading and unloading of the guests is an important aspect of the guests total experience at the ride attraction.

Still referring to FIG. 1, the platform 118 is the part of the loading area 114 where the guests physically load into and unload from the ride vehicles 104. In one aspect of the instant invention, the track 110 forms a half-circle about which the vehicle train 102 passes. The half-circle shape of the track 110 defines a radius of curvature of the track, or Rt. The platform 118 defines an effective periphery 122 that extends along and is generally coextensive with and defines a radius of curvature, Rp, that is similar to the radius of curvature of the inner sides 140 of the ride vehicles 104 that face the platform, Rv. The effective periphery 122 may extend below the ride vehicle 104 and past the inner side 140 of the ride vehicles 104, be closely matching but not interfere with the inner edge 140 of the ride vehicle, or may form a gap between the effective periphery 122 and the inner edge 140 of the ride vehicle 104. Nonetheless, the platform 118 is positioned relative to the ride vehicles 104 such that the guests, whether ambulatory or with special needs, may easily move from the platform 118 to the interior of the ride vehicle 104, or vice versa.

The platform 118 rotates about a center of rotation 120 such that the effective periphery 138 moves at the same rate of speed as the vehicle train 104, as the vehicle train passes through the loading area 114. The platform 118 rests on a framework 142 (See FIG. 2) that rotatably supports and drives the platform 118 at any desired speed for this application. For instance, the framework may include a first rib 144 extending annularly around the underside 146 of the platform 118. A drive mechanism 148, such as a drive wheel driven by a motor, may engage the rib 144 and cause the platform 118 to rotate. The platform may also be supported by an additional support wheel(s) 150 to help rotatingly support the movement of the platform 118 about its rotational axis. The rotation of the platform 118 may be under the control of a human operator, or may move under the control of an automatic program controlling the drive mechanism 148 of the platform 118, or a combination of both. The automatic program may be in communication with the automatic program controlling the movement of the vehicle train 102. The speed of movement of the platform may be at the nominal speed of the ride vehicles 104 through the ride attraction 100, faster than the normal speed, or slower than the nominal speed (including stopped). Other means of rotatably supporting and driving the platform 118 to cause motion about an axis of rotation 120 at a desired and controlled rate are contemplated.

The difference in speed between the movement of the effective periphery 122 of the platform 118 and the vehicle train 102 through the loading area 114 should approach zero, however some relative speed therebetween is contemplated and may be desired. The low relative speed between the platform 118 and the ride vehicles 104 helps the guests load into and unload from the ride vehicles with less difficulty.

The platform 118 may be divided into an active section 152 where guests load and unload onto ride vehicles 104, and an inactive section 154 where guests are not allowed generally because the inactive section 154 may not be near any ride vehicles. The division between the two sections 152, 154 may divide the platform 118 into equal halves, or may divide it into unequal portions. As shown in FIG. 1, a barrier 156 divides the rotating platform 118 between the active area 152 for use by the guests, and an inactive area 154. The active area 152 is the area of the platform 118 that is adjacent the ride vehicles 104 through the loading area 114. The barrier 156 is designed to allow the platform 118 to rotate relative to the barrier, and may take the form of a planar cover, fence-like barrier, or the like. In FIG. 1, the platform 118 rotates under the barrier 156. The barrier 156 may be armed with sensors to alarm and possibly inhibit further motion if a guest rides the platform 118 into or near the barrier 156. Attendants may also be assigned to help guests keep from contacting the barrier. The barrier may also be formed so that if necessary a guest could step up onto the barrier, in which case the guest would no longer be moving with the platform 118.

The platform 118 may be made of wood, metal, rubber, plastic, fiberglass, or any other suitable material or combination thereof capable of withstanding the wear and tear of public use. A non-slip surface may cover all or a portion of the platform 118. The portion of the track 110 that co-extends with the platform 118 may be more or less than a half-circle, depending on the length of time and the distance needed to unload and load guests onto the vehicle train 102. While the effective periphery 122 of the platform 118 closely matches, as described above, the curvature of the track which guides the ride vehicles, the actual periphery of the platform 118 may extend below and beyond the track 110, and may not have a fixed radius of curvature, or no radius of curvature at all.

As shown in FIG. 1, the guests move onto the platform 118 from the ramp 124, and exit the platform 118 from the ramp 124. The ramp 124 extends inwardly from beyond the effective periphery 122 of the platform 118 and forms a pathway for guests to enter and exit. As shown in FIG. 1, the ramp 124 extends through the inactive section 154 and terminates adjacent to the center of rotation 120 of the platform 118. The terminal end 158 of the ramp 124 is positioned near the center of rotation 120 of the platform 118 so that the relative motion between the ramp 124 and the platform 118 is relatively low. The end of the ramp 124, if positioned close to the center of rotation 120 of the platform 118, may also be supported by a post extending through the platform 118 at the center of rotation 120, for structural purposes. However, the ramp 124 may be cantilevered out over the platform 118 if desired. The low relative movement helps the guests transition more easily from the stationary ramp 124 to the moving platform 118.

The ramp 124 extends laterally, such as radially or otherwise, over the platform 118 to allow for a low angle of engagement with the platform 118 such that ambulatory guests and guests in wheelchairs, and other apparatus or equipment, may be moved from the stationary ramp 124 onto the rotating platform 118 with a reasonable level of effort. The terminal end 158 of the ramp may be positioned very close to and in moving engagement with the platform 118 (to allow the platform 118 to move under the ramp even though it is in engagement with the ramp). This may be accomplished by a teflon or other low friction engagement material, rollers, casters, or other similar structure being positioned between the ramp 124 and the platform 118 at the appropriate locations. Alternatively, the terminal end 158 of the ramp may be spaced above the platform 118 by a small amount to help generally keep the ramp and the platform from engaging one another.

The ramp 124 may be divided into two longitudinal portions 160, 162 in order to direct guests to or from the platform.

As shown in FIG. 1, the guests accessing the platform 118 pass down the left side 160 of the ramp onto the platform. The guests exiting the platform 118 pass down the right side 162 of the ramp 124 away from the platform. A physical barrier 164 may be used to divide the ramp 124 into these usage lanes, or a visual indicator, such as lights or paint, may be employed.

The terminal end 158 of the ramp 124 is shown as having a convex curve relative to the length of the ramp 124. This allows easy access to and from side portions of the terminal end, which may make using the ramp easier. The terminal end 158 may also have a straight end, a concave curve, or other shape depending on the desired access to and from the terminal portion of the ramp.

It is contemplated that the ramp 124 may extend onto the platform to terminate in a position not adjacent the center of rotation 120 of the platform 118. This would create a higher relative motion between the terminal end 158 of the ramp 124 and the portion of the platform to which it is adjacent. However, this may be acceptable in some applications where low relative velocity is not necessary or desired. Additionally, more than one ramp 124 may be employed for allowing guests to access and exit the platform. For instance, one ramp may be used to allow guests to access the platform, and one ramp may be used to exit the platform. In this scenario, the access ramp may terminate near the center of rotation 120 of the platform 118, and the exit ramp may terminate closer to or beyond the effective periphery 122 of the platform.

The ramp 124 may be made of any suitable material able to withstand the wear and tear of public use, as well as be structurally sound for either an end-supported bridge or cantilever bridge. The ramp 124 may be integrated with a cover over a portion of the platform 118, or may have a bridge-like structure extending over the moving platform 118.

The loading system 116 of one aspect of the present invention is now described with respect to FIG. 1. The ride vehicles are moving from left to right along the track 110 at a velocity V1. The platform 118 is caused to rotate such that the effective periphery 122 of the platform 118 moves at an angular velocity P1 to substantially match V1. V1 may or may not be the speed at which the ride vehicles 104 move through the attraction 100. Guests ending their ride on the attraction 100, when delivered to the loading area 114, begin de-boarding the ride vehicles 104. Ambulatory guests open the door 138, if there is one, on the ride vehicle 106 and dismount onto the platform 118. Guests riding on WAVs 108 move the tray 128 from the retracted to the extended positions over the platform 118 so that their wheelchairs 130 may be moved from the tray 128 onto the platform 118. Once exited from the ride vehicles 104 and on the platform 118, the guests move towards the terminal end 158 of the ramp 124, which is adjacent the rotational center 120 of the platform 118. The guests move from the platform 118 onto the terminal end 154 of the ramp 124, and move along the exit portion 162 of the ramp 124 to exit the ride attraction 100.

Guests entering the ride attraction 100 move to the loading zone 114 by moving along the entrance portion 160 of the ramp 124 to its terminal end 158. When at the terminal end 158 of the ramp 160, the guests pass from the terminal end 158 of the ramp 124 onto the moving platform 118. The relative velocity between the terminal end 158 of the ramp 124 and the platform 118 is relatively low given the position of the terminal end of the ramp 124 being adjacent the center of rotation 120 of the platform 118. Once on the platform, the guest moves towards his or her left, moving toward the effective periphery 122 of the platform 118 and a selected ride vehicle 104. The guest may be directed by an attendant, or may choose a ride vehicle on their own. Ambulatory guests move into a ride vehicle 106 by opening the door 138, if there is one, on the ride vehicle and move through the opening onto the ride vehicle 106. Guests in wheelchairs 130 select a WAV 108, and with the tray 128 in the extended position, move their wheelchair 130 onto the tray 128. This may be done under their own power, or with the help of an attendant. Once on the tray 128, the tray is moved to its retracted position to position the guest in the wheelchair 130 in region 132 inside the WAV 108.

The unloading of guests ending the previous ride on the attraction 100, and the guests beginning the next ride on the attraction navigate through the loading and unloading zone 114. The unloading and loading process must occur in the active section 152 of the platform 118, and before the cars adjacent the loading zone 114 move through the loading zone and away from the active zone 152 of the platform 118. Where the speed of the ride vehicles 104 in the loading zone 114 is substantially similar to the speed of the ride vehicles 104 through the rest of the ride attraction 100, the loading and unloading delay is minimized. Where this speed is relatively high, the loading zone and/or the diameter of the platform 118 or the effective perimeter 122 must be sized accordingly to give guests sufficient time to unload and load. One way to provide sufficient time for loading and unloading, other than slowing the ride vehicles 104 down, is to make the radius of curvature of the platform 118 and the track 110 larger rather than smaller. This will provide more time for guests to load and unload from the ride vehicles 104. Where the speed of the ride attraction 100 is relatively small, the loading zone 114 or radius of curvature of the platform 118 may be reduced.

The tray 128 used in the loading system 116 shown in FIG. 1 aids loading and unloading of a guest in a wheelchair 130 from a WAV 108. The tray 128 of FIG. 1 has a floor section 166 that is movingly supported by the chassis 168 of the ride vehicle 104 to allow the floor section 166 to move from an extended position to a retracted position. The floor section 166 is made of a high-strength, relatively rigid material to allow it to support the weight of a guest in a wheelchair 130, and also to withstand the extension and retraction motion. The floor section 166 extends out over the platform 118 from the ride vehicle chassis 168, and may extend in a cantilever manner without touching the platform 118, or may rest at least partially on the platform 118 when extended. While there may be no relative movement between the platform 118 and the tray 128, the tray 128 may be able to move relative to the platform 118 if necessary by means of a low-level frictional engagement that slides, or by casters to allow a rolling engagement. The floor section 166 is relatively thin in cross section to allow a wheelchair 130 to roll up onto and off of the tray 128 as desired. The floor section 166 has a front edge 170 and a rear edge 172 that may be tapered to facilitate access and unmounting of wheelchair 130 from the floor section 166. The floor section 166 may also include a lateral side-wall 174 that acts to at least partially cover the opening 126 in the ride vehicle when the tray 128 is moved to its retracted position. Different configurations of the tray 128 of FIG. 1 and other similar structures are shown in FIGS. 2 through 12.

Figure 2:
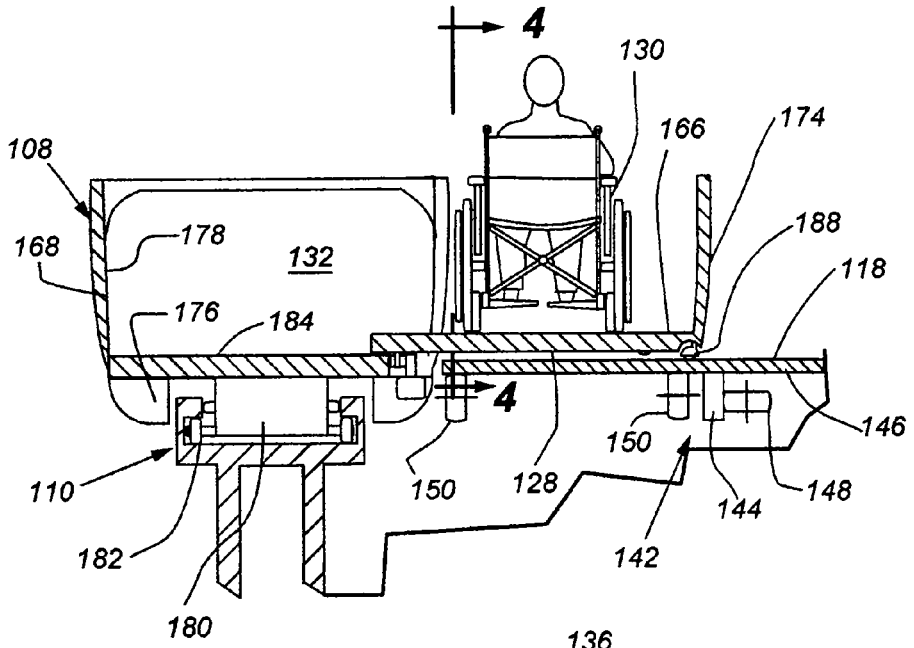
FIG. 2 illustrates a ride vehicle and extending tray for allowing the mount and dismount of a wheelchair passenger from the ride vehicle.

FIGS. 2 through 6 show one example of the tray 128 structure used in the loading system 116 of FIG. 1. The WAV 108 has a chassis 168 that includes a bottom section 176 and surrounding walls 178. The chassis 168 includes a wheel and axle 180 structure positioned in a guide 182 formed on the track 110 to allow the ride vehicle 104 to move around the track 110 as desired. The chassis 168 includes an internal floor 184 that supports the tray 128 in its retracted position. A roller guide 186 may be formed between the internal floor 184 of the chassis 168 and the tray 128 to facilitate the extension and retraction of the tray 128 from the chassis 168 in an aligned manner. The tray 128 may include rollers or wheels on its bottom surface to engage the internal floor 184 during movement of the tray 128. The external, lateral edge of the tray 128 may include a roller 188 to support the end of the tray 128 on the platform 118 when moving between positions. FIG. 2 shows the guest and the wheelchair 130 on top of the tray 128 and ready for movement into the retracted position.

Figure 3:
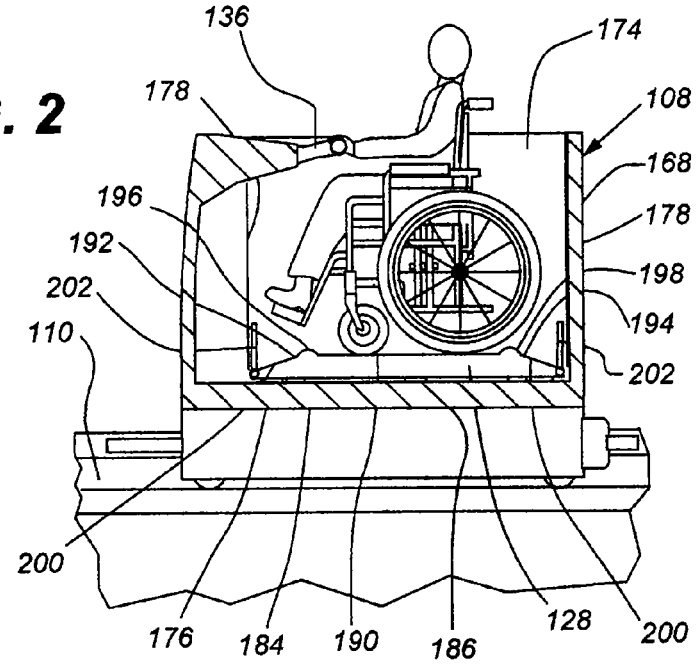
FIG. 3 illustrates the sliding tray structure of FIG. 2 in the non-extended position with the wheelchair passenger in the ride vehicle.
Figure 5:
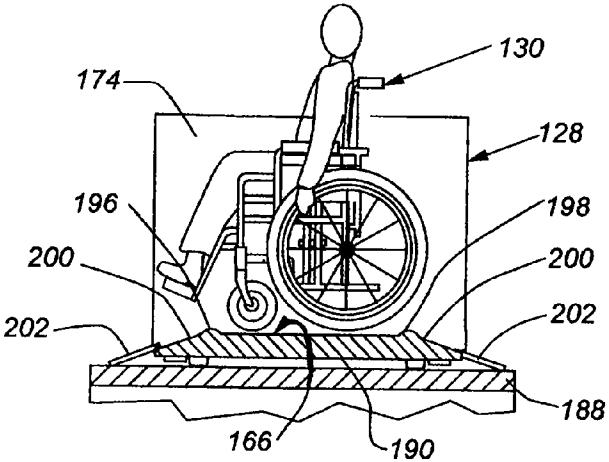
FIG. 5 illustrates the sliding tray extended from the ride vehicle with the dismount ramps deployed to allow the wheelchair passenger to move from the tray to the turntable.
Figure 6:
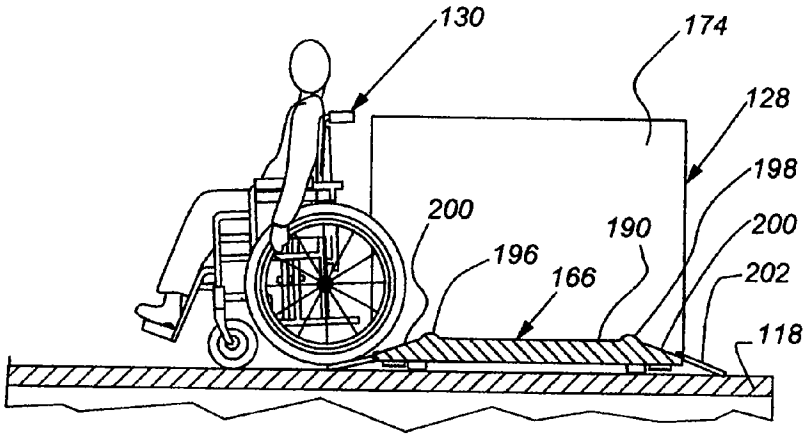
FIG. 6 illustrates the wheelchair passenger dismounting from the tray onto the turntable platform.
Figure 4:
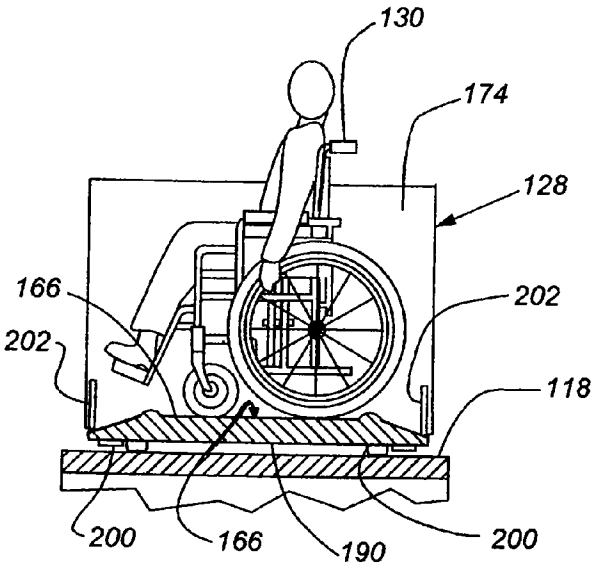
FIG. 4 illustrates the sliding tray extended from the ride vehicle, with the wheelchair passenger preparing to dismount the tray.

FIG. 3 shows the guest and the wheelchair 130 once retracted into the WAV 108. The tray 128 in this instance has a raised central portion 190 defining the area where the wheelchair should be positioned when properly on the tray 128. The front 192 and rear 194 edges of the raised central portion 190 are defined by a front 196 and rear 198 ridge that helps keep the wheelchair 130 from rolling off of the raised central portion 190. Fore and aft of the raised central portion 190, the tray 128 slopes down to form an angled surface 200 to help guide the wheelchair 130 up onto the raised central portion 190. A fold-up tab 202 is pivotally attached at the front edge and the rear edge of the tray 128 to help transition the height gap between the platform 118 and the tray 128. The fold-up tabs 202 may not be required if the height gap between the platform 118 and the tray 128 is small enough to be easily rode over by the wheels of the wheelchair 130. FIGS. 4, 5 and 6 show this exemplary embodiment of the tray 128 in the extended position from the WAV 108, with the guest in the wheelchair 130 dismounting the tray 128.

In FIG. 4, the wheelchair 130 is positioned in the raised central portion 190, having just completed the ride attraction 100, with the tray 128 extended for dismount, and the fold-up tabs 202 in the folded position. FIG. 5 shows the front and rear fold-up tabs 202 having been deployed to the use position. FIG. 6 shows the guest in the wheelchair 130 having moved over the front ridge 196, onto and over the angled front portion 200 of the tray 128, and riding over the deployed front fold-up tab 202 onto the platform 118. Moving the guest in the wheelchair 130 onto the tray 128 is done in generally reverse order. The tray 128 in this embodiment may be retracted and extended manually, or may be moved automatically, such as by a screw, chain, or other drive mechanism. The end of the tray 128 corresponding to the opening in the chassis may form a wall 174 to at least partially close over the opening 126. The wall 174 may itself have an opening formed therein to allow ambulatory guests to utilize the WAV where no guests in wheelchairs need to use the WAV. The ambulatory guests may unfold the foldable seat(s) 134 in the WAV 108 and enjoy the ride attraction.

Figure 7:
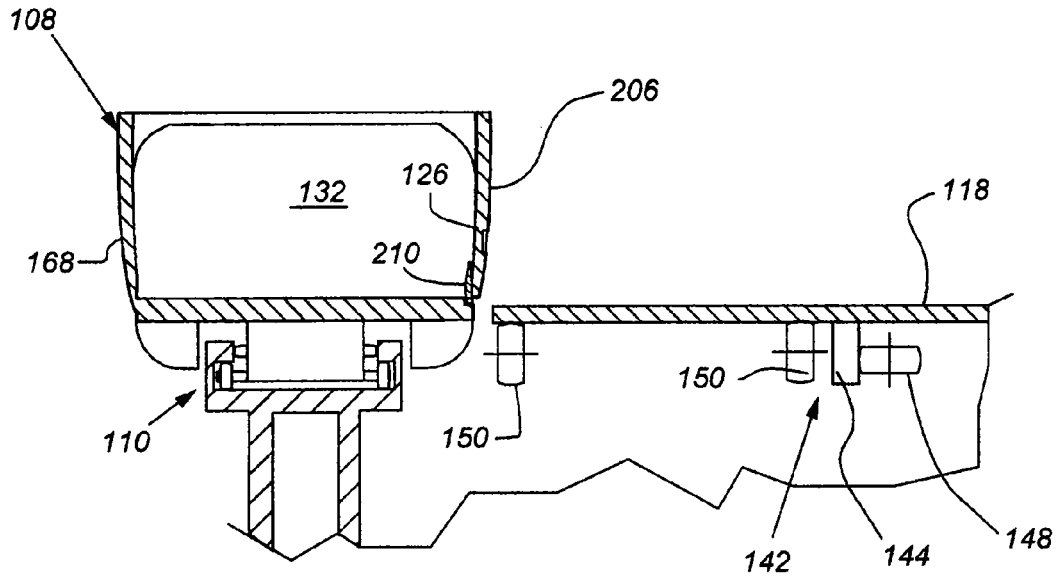
FIG. 7 illustrates another example of a ramp, in a retracted position, for use in allowing mount and dismounting of a wheelchair passenger from a ride vehicle.
Figure 8:
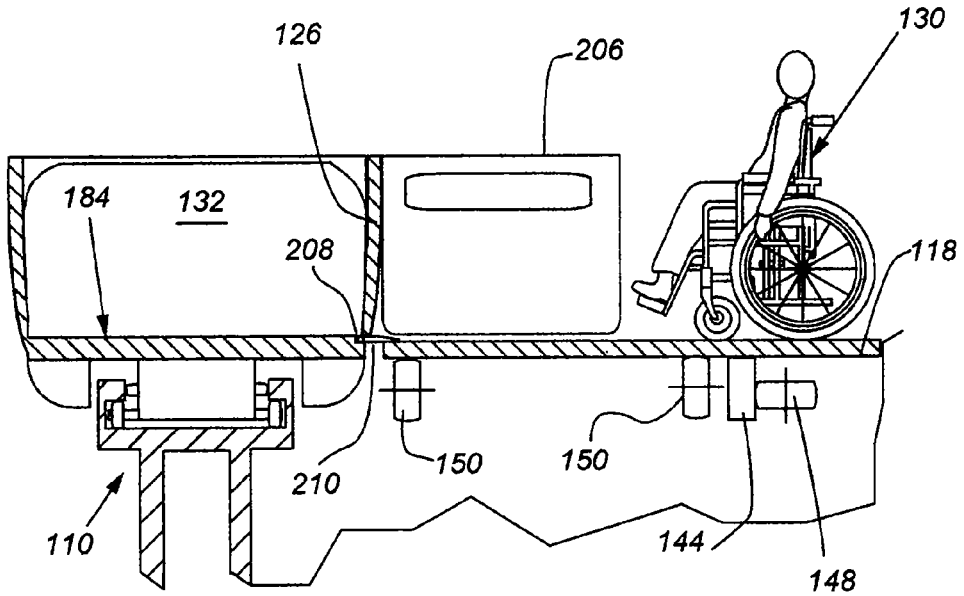
FIG. 8 illustrates the ramp of FIG. 7 in the extended position to allow the mounting or access of a wheelchair passenger into a ride vehicle.

FIGS. 7 and 8 show another exemplary embodiment of a structure to allow a guest in a wheelchair 130 to load onto and off from a WAV. In FIG. 7, the chassis 168 of the WAV 108 includes an opening 126 selectively closed by a door structure 206. At the bottom 208 of the opening, a fold-down tab 210 is positioned in a pivotal relationship with the floor 184 of the WAV 108. The tab 210, as shown herein, is folded up when the door 208 is closed, and may be extended when the door 208 is opened. As shown in FIG. 8, the tab 210 extends from the floor 184 of the WAV 108 to the platform 118 to span that space therebetween and allow the wheelchair 130 to roll over the gap without incident. While the level of the platform 118 is shown as being about the same as the level of the floor 184 of the WAV 108, it is contemplated that even some difference in levels may be accommodated by the fold-down tab 210. The tab 210 is configured to allow for some relative movement between the WAV 108 and the platform 118, as is noted elsewhere herein. Once the door 208 is opened, and the tab 210 is positioned in the extended position, the guest in the wheelchair 130 may roll into the WAV 108, orient him or herself as desired in the WAV for the ride attraction 100, fold up the tab (automatically or manually) 210, and close the door 208. It is contemplated the tab 210 may be positioned outside of the closed door 208. The loading and unloading may be done with or without the help of an attendant.

Figure 9:
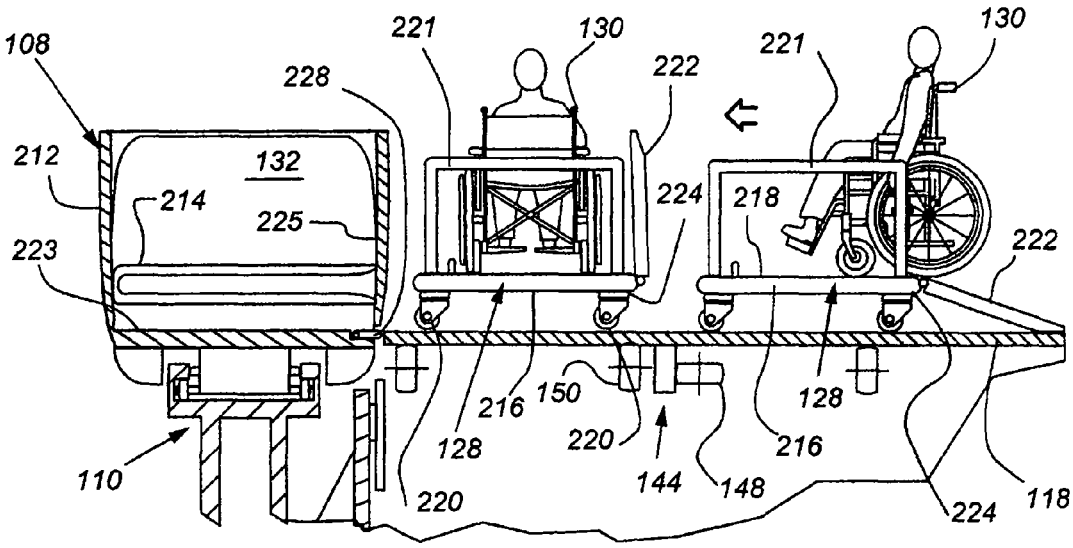
FIG. 9 illustrates another example of a wheelchair user loading into a ride vehicle, with a cassette on which the wheelchair user is positioned being loaded into the ride vehicle.
Figure 10:
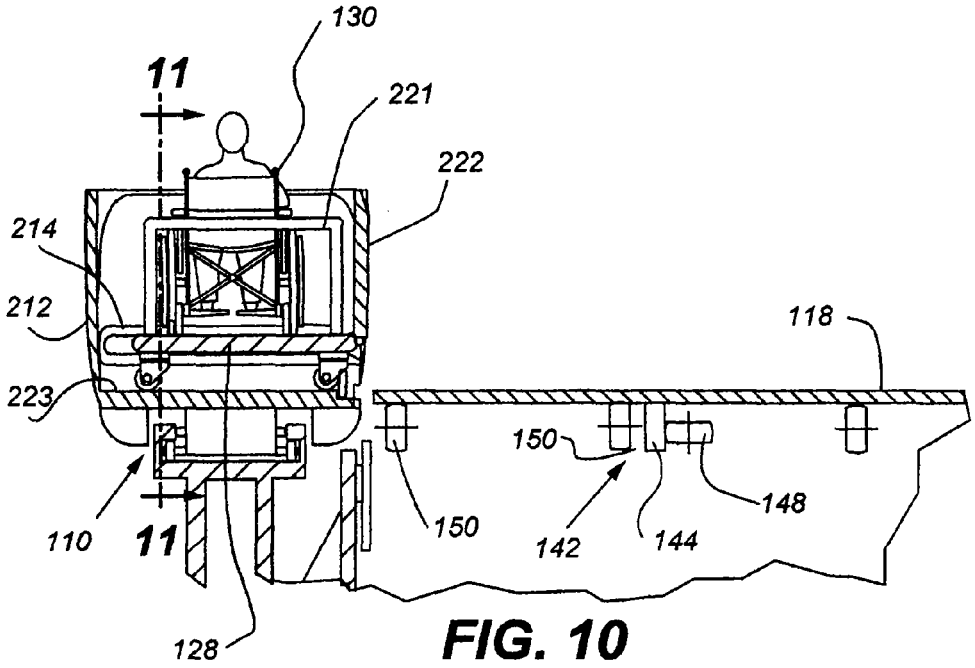
FIG. 10 illustrates the cassette positioned in the ride vehicle.
Figure 11:
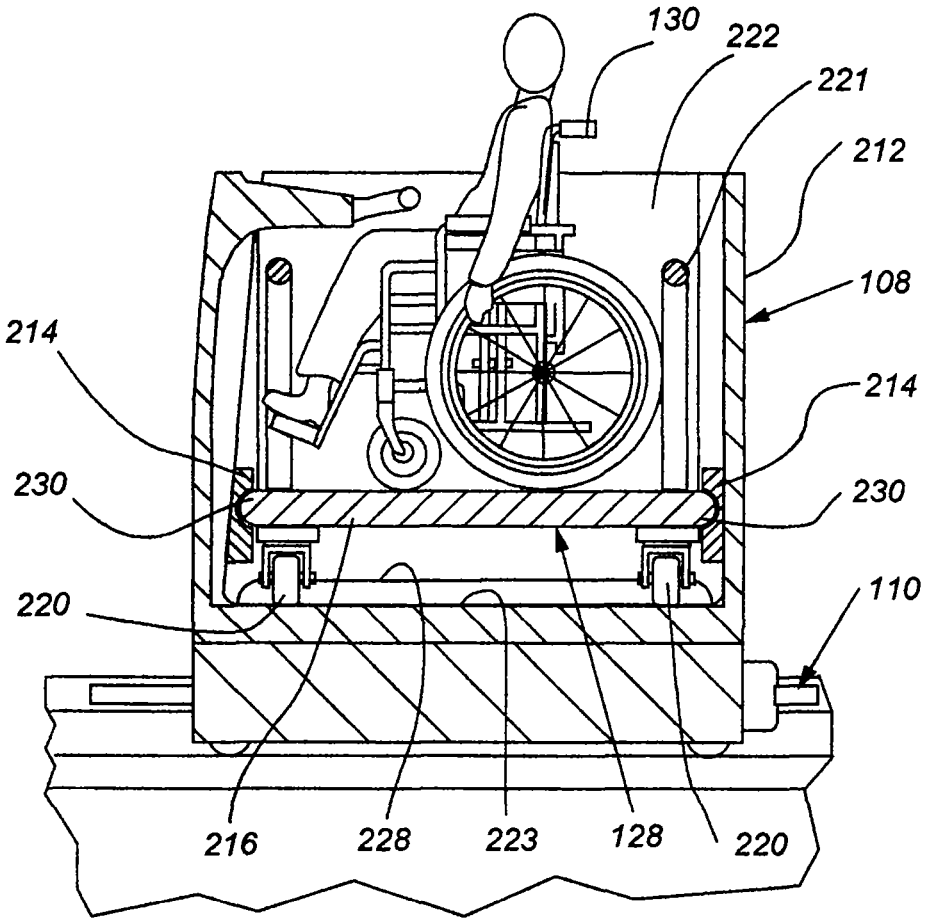
FIG. 11 illustrates another perspective of the cassette positioned in the ride vehicle.

FIGS. 9, 10 and 11 show another exemplary embodiment of a tray 128 structure for loading and unloading a guest in a wheelchair 130 into and out of a WAV 108. FIG. 9 shows a chassis 212 of a WAV 108 on a track 110, as described above. In this version, however, the inside of the chassis 212 includes a channel or channels 214 for receiving a cassette structure 216 on which the guest in the wheelchair 130 is positioned. The channels 214 are positioned in the chassis 212 to engage the cassette 216 and hold it in position inside the chassis 212. Also shown in FIG. 9 is a guest in a wheelchair 130 moving onto the cassette structure 216 (right side of FIG. 9). The guest then reorients herself on the cassette structure 216 (middle portion of FIG. 9). The cassette 216 includes a top receiving surface 218 supported by a plurality of wheels 220 or casters to allow the cassette 216 to roll on the platform 118 as needed, as well as to roll into the WAV 108 through the opening 225 in the sidewall as is explained. A pair of handrails 221 may extend upwardly and along select edges of the cassette 216 (only one shown in FIG. 9, behind the guest). The cassette 216 includes a ramp 222 pivotally attached adjacent an edge 224 to the top surface 218. The edge 224 to which the ramp 222 is attached may not include a handrail, to avoid interfering with the guest's access to the top surface of the cassette. The ramp 222 is movable between an upright or retracted position, and a deployed or extended position. The ramp 222 may be moved between these two positions manually or automatically by means of a motor or the like. The manual and automatic actuation may be accomplished by the guest or an attendant, by way of a actuation switch, or by a chain or lever for manual actuation. When upright, the ramp 222 is held in place and may form at least a partial closure to the opening in the WAV 108, as will be explained. When in the deployed position, the ramp 222 extends from the top surface 218 to the platform 118 to form an angled surface for the wheelchair 130 to be pushed up onto the top surface 218, or to allow the wheelchair 130 to move from the top surface 218 to the platform 118. The height of the top surface 218 from the platform 118 may be relatively small in order to keep the angle of the ramp 222 to a minimum for ease of loading and unloading the wheelchair onto the cassette 216, and may depend in part on the size of the casters or wheels.

Once the wheelchair 130 is mounted on the cassette 216, as is also shown in the middle part of FIG. 9, the guest in the wheelchair 130 may decide to re-orient him or herself on the cassette 216 in order to face the desired way in the WAV 108 during the ride attraction 100. The handrails 221 may aid the guest in accessing the cassette 216, may help act as a constraint on the cassette, and may assist the guest in re-orienting the wheelchair 130 on the cassette 216. Because the guest in the wheelchair 130 is positioned on the cassette 216, and the cassette 216 may not be physically attached to the WAV 108, the cassette 216 may be moved on the platform 118, with the guest positioned thereon, as is desired. The cassette 216 may be moved to a different WAV 108 for insertion therein, or upon extraction from the WAV 108 after the ride attraction 100, the cassette 216 may be moved towards the platform 118 exit 124. The guest in the WAV 108 may be off-loaded from the cassette 216 near the WAV 108 from which it was removed, for convenience of the next guest, or near the exit ramp 124, or elsewhere. The loading and unloading of the cassette 216 may be accomplished by the guest, with or without the help of an attendant.

FIGS. 10 and 11 show the cassette 216 with the wheelchair 130 and guest loaded thereon, inserted into the chassis 212 of the WAV 108. The floor 223 of the chassis 212 is at about the same level as the top of the platform 118, and the casters 220 on the bottom of the cassette 216 allow the cassette to be maneuvered from the platform 118 to the chassis 212 with the help of an attendant. A small tab 228 may be used to span the gap between the WAV 108 and the platform 118 if needed, for the casters 220 to roll across. The edges 230 (See FIG. 11) of the cassette 216 are inserted into the channels 214 for constrained positioning in the WAV 108. It is contemplated that the channels 214 do not need to vertically constrain the cassette 216 as for many rides the force of gravity is sufficient to keep the cassette 216 in position. The lateral forward and rearward position of the cassette 216 in the chassis may be controlled by the channels in order to hold the cassette in a stable position during the ride attraction 100. Once positioned in the chassis 212, the fold-up ramp 222 may form a barrier to the opening 225, or the opening 225 may have its own door associated therewith to close over the opening.

Figure 12:
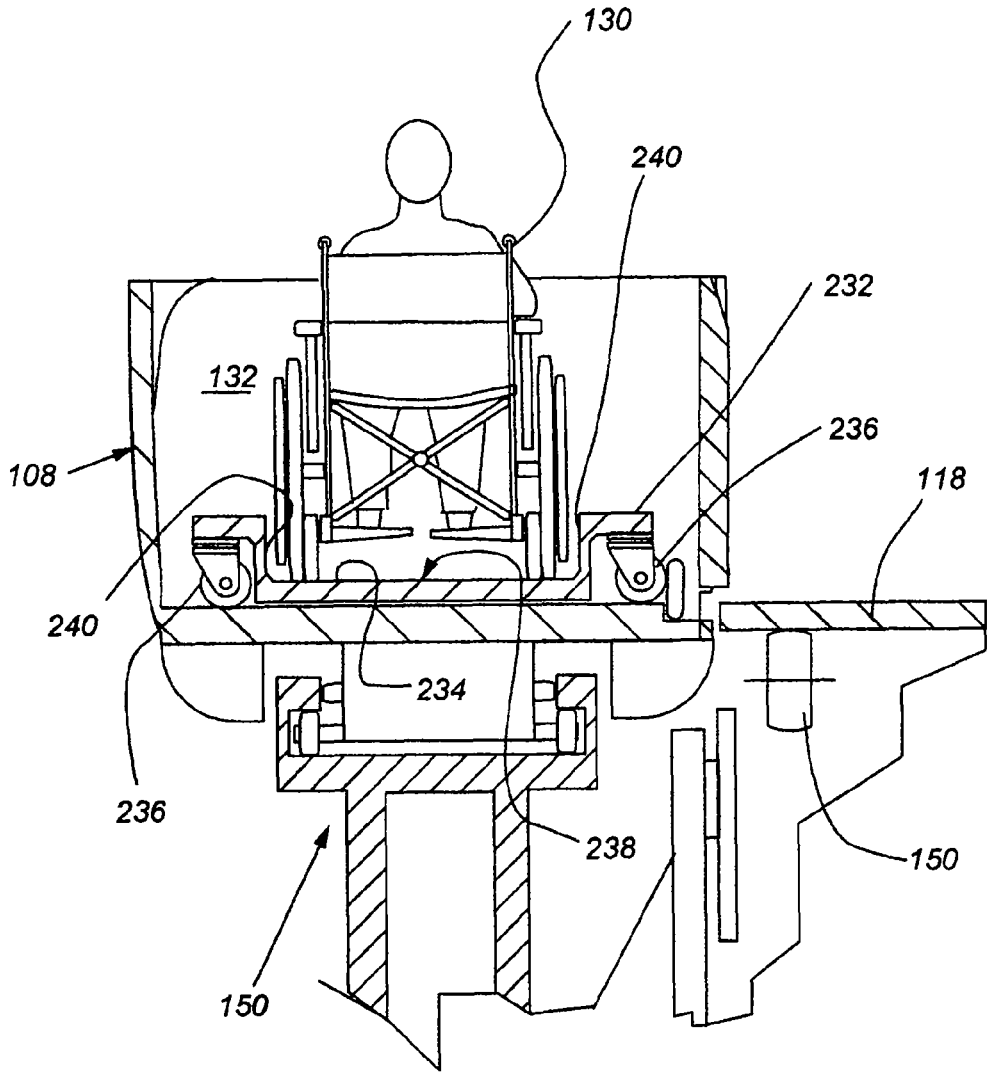
FIG. 12 illustrates another example of a cassette for use in loading a wheelchair passenger into a ride vehicle.

Another exemplary embodiment of a cassette type tray is shown in FIG. 12. The cassette 232 in FIG. 12 has a top surface 234 positioned closer to the support surface on which it rests, such as the platform 118 or the interior of WAV 108. The cassette 232 is supported upon the platform 118 or in the WAV 108 by a plurality of caster or roller wheels 236. Between the caster or roller wheels 236, the cassette 232 forms a U-shaped structure 238 to move the top surface 234 towards the platform 118 to allow more convenient mounting by the guest in the wheelchair 130. Because of the U-shaped 238 depression in the cassette 232, the guest may not be able to re-orient herself on the cassette 232 once mounted thereon, so the guest may load onto the cassette 232 in the orientation desired for the ride attraction 100, which normally is facing forward when loaded into the WAV 108. This would typically require the guest to load forwardly from the rear edge, or rearwardly from the front edge of the cassette 232. The raised sidewalls 240 of the cassette 232 help constrain the wheelchair 130, and optional movable barriers (not shown) may be actuated on the front and/or rear access edges on the cassette 232 for further constraint if desired. The guest in the wheelchair 130 loads the cassette 232 by rolling onto the edge of the lower top surface 234. A fold down-tab, such as tab 202 shown on the front and rear edges of the tray in FIG. 4, may be employed if necessary.

After the guest is loaded onto the cassette 232 of FIG. 12 while on the platform 118, the cassette is loaded into a WAV 108 by an attendant, or automatically, with the guest facing the desired orientation. As with the example of FIGS. 9-11, the floor of the WAV 108 may be aligned with the top surface of the platform 118 so the cassette may be rolled directly into the WAV. A deployable tab 242 may be deployed to span any gap therebetween, or to allow for elevational changes therebetween, may be used. The opening in the WAV 108 through which the cassette 232 is loaded into the WAV 108 may be left uncovered, or may be closed by a door associated with the WAV. The fold-down tab 242 is shown in FIG. 12 in the retracted position to act to restrain the cassette 232 from undesired movement during the ride attraction.

The loading system 116 shown in FIG. 1 may also be employed where the platform 118 is in the form of a moving walkway 244. In this setting, the moving walkway 244 of the present invention includes a train 102 of ride vehicles 104 as described above, some of the ride vehicles being WAVs 108. The WAVs have tray 128 structures for allowing a guest in a wheelchair 130 to be loaded and unloaded onto the WAV 108, such as those described above, or other such structures. The moving walkway 244 may be curved or straight. The curved moving walkway 244 may be long enough to allow several guests to have access to several ride vehicles in the loading area 245. The moving walkway 244 moves at about the same speed as the ride vehicles 104, as described above with respect to the platform of FIG. 1.

Figure 13:
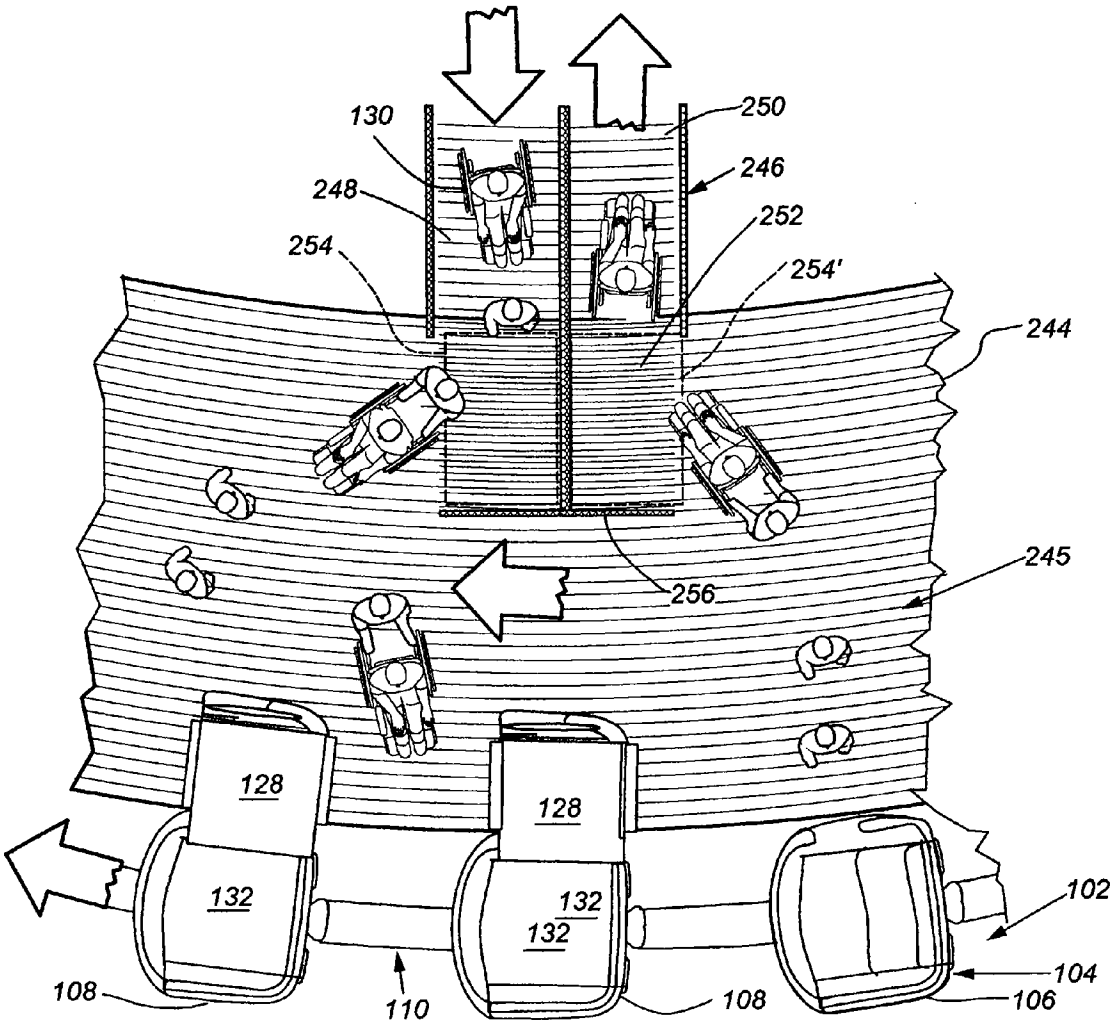
FIG. 13 illustrates the load system of the present invention embodied in a load platform including a moving walkway.

The ramp 246 onto the moving walkway 244 extends to the walkway 244, and may have an entrance portion 248, as well as an exit portion 250. The entrance portion 248 and the exit portion 250 extend onto the moving walkway 244 with a comb 252, which is commonly used in the escalator technologies that meshes with the moving walkway 244 to allow the user transition from a stationary surface of the ramp 246 to a moving surface smoothly and relatively easily. The comb may be a cantilever structure extending into the moving walkway, or may be supported on the moving walkway by a roller mechanism. The transition areas 254 and 254' are sized sufficiently to allow the user to change orientation and speed from the entrance portion 248 onto the moving walkway 244, and change orientation and speed from the moving walkway onto the exit portion 250. Barriers 256 may be used to separate the entrance 248 from the exit 250 portion, and from both the entrance and exit portion to the moving walkway 244 in general for safely, convenience, and efficient movement of guests onto and off of the ride vehicles. The entrance 248 and exit 250 ramp may be separate ramps providing access to and exit from the moving walkway 244. The entrance and exit ramp 246 extends in this embodiment from the exterior of the moving walkway and does not have to pass over the moving walkway. This is because the transition comb 252 allows the guests to access the moving walkway 244 without having to be positioned at a location of low relative velocity between the two. In FIG. 13, the train 102 of ride vehicles 104 is shown on the outside curve of the curved moving walkway 244, with the entrance 248 and exit 250 ramp on the inside curve of the moving walkway 244. Given the flexibility of the moving walkway structure 244, the train 102 of ride vehicles 104 may be oriented on the inside curve of the moving walkway 244 with the entrance 248 and exit 250 ramp on the outside curve of the moving walkway.

The loading of guests onto a WAV 108 and unloading of guests off of a WAV from the moving walkway 244 platform of FIG. 13 is similar to that described above with respect to FIG. 1. Guests in wheelchairs 130 unloading from the WAV 108 after a ride attraction 100, unload onto the moving walkway using the tray 128 as described above, and move toward the exit ramp 250. In the system shown in FIG. 13, the guests unload generally at the right, and move across the moving walkway 244 toward the exit ramp 250. Arriving guests move onto the moving walkway 244 from the entrance ramp 248, and across the moving walkway toward their desired ride vehicle.

Figure 14:
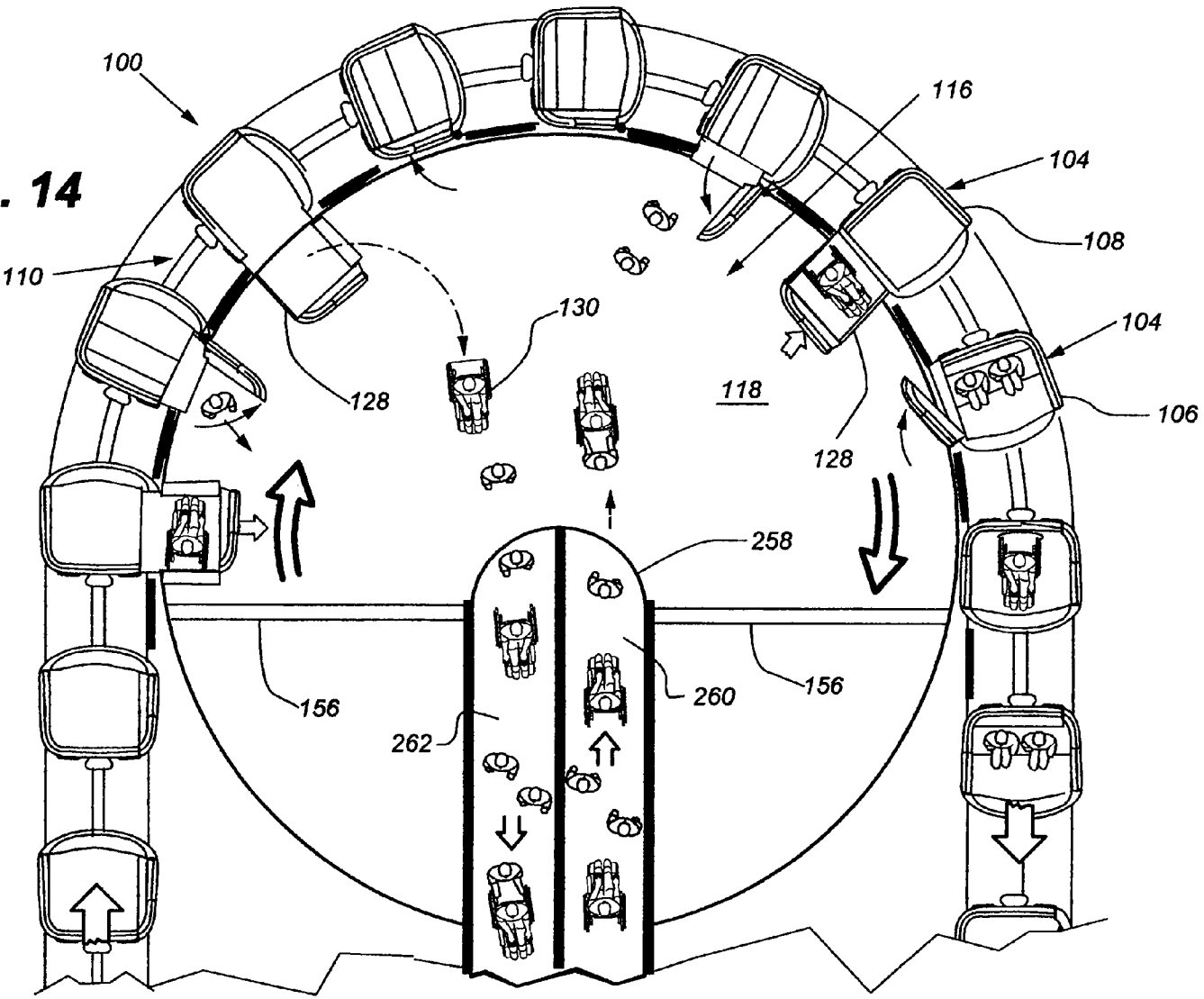
FIG. 14 illustrates the load system of the present invention, similar to FIG. 1, with additional options for passenger flow.

FIG. 14 shows an alternative passenger loading system to that shown in FIG. 1. The structures shown in FIG. 14 are largely the same as those in FIG. 1, but the orientation of the on and off ramp portions are modified as explained hereafter. In FIG. 1, the entrance portion 160 of the ramp 124 extends down the left side of the ramp, while the exit portion 162 from the ramp 124 extends up the right side of the ramp 124. In FIG. 14, the ramp 258 is divided so that the entrance portion 260 extends down the right side portion of the ramp 258, and the exit portion 262 extends up the left side portion of the ramp 258. This entrance and exit movement may work to flow the guests more naturally with the clockwise rotation of the platform 118. Since the platform 118 in this example rotates clockwise, the guests may be exiting from the left portion of the platform 118. With the exit portion 262 of the ramp 258 on the left side of the ramp and thereby closer to the region of the platform 118 where the guest off-load from the ride vehicles 104, it may be more convenient for guests to access the exit ramp 262 in this orientation. With the loading portion 260 of the ramp 258 on the right side of the ramp and thereby closer to the region of the platform 118 where the guest load onto the ride vehicles 104, it may be more convenient for guests to leave the exit ramp 262 in this orientation. In this orientation, the exiting and oncoming guests will likely not need to cross-over paths, and thus have a more convenient time finding and loading a ride vehicle 104.

Although examples of this invention have been described above with a certain degree of particularity, those skilled in the art could make numerous alterations to the disclosed embodiments without departing from the spirit or scope of the invention as described in the specification, drawings and claims. For instance, while the rotating platforms are shown with the ride vehicles wrapping around a portion of the outer circumference of the platform, it is contemplated that in some instances ride designers may wish for the ride vehicles to be adjacent the inside curve of an annularly (donut) shaped platform. The mechanics of loading and unloading would be similar to that as shown with respect to the moving walkway of FIG. 13. Additionally, where a fold-down tab is used to span the gap from the WAV to the platform or moving walkway (such as may be described above regarding FIGS. 2-12), there may be a roller structure positioned between the tab and the platform or moving walkway to allow relative movement therebetween. All directional references (e.g. upper, lower, upward, downward, left, right, leftward, rightward, top, bottom above, below, vertical, horizontal, clockwise, and counterclockwise) are used for identification and explanation purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, these joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing form the spirit of the invention as defined in the appended claims.

What is claimed is:

1. A ride loading interface system for allowing at least one rider to access a ride vehicle, said system comprising:

a plurality of associated ride vehicles moving on a track at a rate greater than zero during loading of said plurality of associated ride vehicles, each ride vehicle including an opening, at least one ride vehicle including a tray extendable from and retractable into said at least one ride vehicle through said opening, said tray for receiving a wheelchair and for allowing a wheelchair to be positioned in said at least one ride vehicle;

a loading deck positioned adjacent said track and said plurality of ride vehicles, said loading deck having a rate of motion greater than zero such that said portion of said loading deck adjacent said track is moving at about the same rate as said plurality of ride vehicles; and at least one structure extending into said loading deck to allow a rider to transition from said structure to said loading deck with a small change in relative velocity of said rider to said loading deck, wherein:

said track comprises a rail structure slidably connected with said plurality of associated ride vehicles, said rail structure having a guide for defining motion of said plurality of associated ride vehicles in a first direction and restraining motion of said plurality of associated ride vehicles in a second direction.

2. A system as defined in claim 1, wherein:

said track guides said plurality of ride vehicles along at least a portion having a curved path;

said loading deck includes a platform rotating about a center of rotation; and said at least one structure extending to adjacent said center of rotation of said platform to allow a rider to transition from said structure to said platform at a small change in angular velocity.

3. A system as defined in claim 2, wherein said at least one structure allows a rider to exit said platform.

4. A system as defined in claim 3, wherein said at least one structure extends substantially coextensive with said platform.

5. A system as defined in claim 4, wherein said at least one structure extends substantially adjacent to said platform.

6. A system as defined in claim 3, wherein said at least one structure is divided into at least two longitudinal regions, one of said longitudinal regions designated as an access region and the other of said longitudinal regions designated as an exit region.

7. A system as defined in claim 2, wherein:

at least one portion of said curved path has a fixed radius of curvature; and said platform has a periphery defining a radius substantially similar to said radius of curvature of said at least one curved portion of said path.

8. A system as defined in claim 2, wherein said platform defines a periphery, and said periphery and said plurality of ride vehicles have substantially the same rate of movement.

9. A system as defined in claim 2, wherein less than said whole platform is capable of use by riders.

10. A system as defined in claim 1, wherein:

said loading deck includes a moving walkway; and said at least one structure includes a transition area for said at least one rider to access said moving walkway.

11. A system as defined in claim 10, wherein said transition area includes a comb in meshing engagement with said moving walkway to allow said rider to transition from a stationary surface of said at least one structure to a moving surface of said moving walkway.

12. A system as defined in claim 10, wherein said transition area includes a ramp extending over but adjacent to said moving walkway.

13. A system as defined in claim 10, wherein said track guides said plurality of ride vehicles along at least a portion of a straight path.

14. A system as defined in claim 10, wherein said track guides said plurality of ride vehicles along at least a portion of a curved path.

15. A system as defined in claim 10, wherein said at least one structure is divided into at least two longitudinal regions, one of said longitudinal regions designated as an access region and the other of said longitudinal regions designated as an exit region.

16. A ride loading interface system as defined in claim 1, wherein said ride vehicle further comprises:

a chassis having an interior;

said tray retractable and extendable from said interior through said opening, said tray including a receiving area for a wheelchair, and having at least one edge positioned adjacent the platform; wherein when extended adjacent the platform, the wheelchair may access the receiving area and the tray may be retracted into said interior space of said chassis.

17. A ride vehicle as defined in claim 16, wherein said tray is movingly engaged with said chassis.

18. A ride vehicle as defined in claim 16, wherein said tray includes a wall, said wall covering said access opening when said tray is positioned inside said interior of said chassis.

19. A system as defined in claim 1, wherein said tray comprises:

a floor section; and a wall extending upward relative to said floor section, wherein when said tray is retracted into said at least one ride vehicle said wall forms at least a portion of an outer wall of said at least one ride vehicle.

20. A system as defined in claim 19, wherein said wall is fixedly attached to said floor section.

21. A system as defined in claim 1, wherein said rail structure comprises a guide that restrains motion of said plurality of associated ride vehicles in a third direction.

22. A system as defined in claim 21, wherein said guide comprises a lip extending substantially perpendicular relative to said rail structure for restraining said plurality of associated ride vehicles in said third direction.

23. A system as defined in claim 21, wherein:

said rail structure includes a plurality of rails;

said plurality of associated ride vehicles includes a plurality of wheels; and said lip is positioned between a bottom surface of said plurality of associated ride vehicles and said plurality of wheels.

24. A system as defined in claim 1, wherein said tray further comprises a tab pivotably connected to said floor section and pivotable between a folded position and an extended position, wherein:

in said folded position said tab extends upward relative to said tray to substantially restrict a wheelchair from entering or exiting said tray; and in said extended position at least one edge of said tab is positioned adjacent said loading deck to permit a wheelchair to enter or exit said tray.

25. A system as defined in claim 1, wherein said tray further comprises a roller positioned adjacent a lateral edge of said tray for supporting said tray when moving between an extended position and a retracted position.

26. A system as defined in claim 1, wherein said tray further comprises a plurality of ridges extending substantially upward relative to said floor section to prevent a wheelchair from rolling off of said tray.

27. A ride loading interface system for allowing at least one rider to access a ride vehicle, said system comprising:

a plurality of associated ride vehicles moving on a track at a rate greater than zero during loading of said plurality of associated ride vehicles, each ride vehicle including an opening, at least one ride vehicle including a tray extendable from and retractable into said at least one ride vehicle through said opening, said tray for receiving a wheelchair and for allowing a wheelchair to be positioned in said at least one ride vehicle, wherein said ride vehicle comprises:

a chassis having an interior; wherein said tray is retractable and extendable from said interior through said opening, includes a receiving area for a wheelchair, and has at least one edge positioned adjacent the platform; wherein when extended adjacent the platform, the wheelchair may access the receiving area and the tray may be retracted into said interior space of said chassis, wherein further said tray is movingly engaged with said chassis and wherein said tray is a cassette disengable from said chassis;

a loading deck positioned adjacent said track and said plurality of ride vehicles, said loading deck having a rate of motion greater than zero such that said portion of said loading deck adjacent said track is moving at about the same rate as said plurality of ride vehicles; and at least one structure extending into said loading deck to allow a rider to transition from said structure to said loading deck with a small change in relative velocity of said rider to said loading deck.

28. A ride vehicle as defined in claim 27, wherein:

said receiving area is positioned spaced above said platform; and a ramp is pivotally attached to said cassette for movement between a retracted position where it forms a covering for said access opening when said chassis is positioned in said interior of said chassis, and an extended position to facilitate positioning said wheelchair on said receiving area.

29. A ride vehicle as defined in claim 27, wherein said receiving area is positioned above but adjacent to said platform.

30. A method of loading a wheelchair-bound guests onto a ride attraction comprising:

moving at least one ride vehicle on a track at approximately the same rate as a loading deck associated therewith during loading of said at least one ride vehicle, said rates both being greater than zero;

extending a tray from said at least one ride vehicle over said loading deck for receiving the wheelchair-bound guest; and retracting said tray into said ride vehicle to position the wheelchair-bound guest in said at least one ride vehicle, wherein said track comprises a rail structure slidably connected with said plurality of associated ride vehicles, said rail structure having a guide for defining motion of said plurality of associated ride vehicles in a first direction and restraining motion of said plurality of associated ride vehicles in a second direction.

31. A method as defined in claim 30, wherein said rate of said ride vehicle during moving, extending and retracting is relatively the same as a rate of said ride vehicle through said ride attraction.

* * * * *